US009890601B2

(12) United States Patent
Baudoin

(10) Patent No.: US 9,890,601 B2
(45) Date of Patent: Feb. 13, 2018

(54) MECHANICALLY ACTIVATED BYPASS VALVE APPARATUS AND METHOD

(71) Applicant: KLX ENERGY SERVICES LLC, Houston, TX (US)

(72) Inventor: Toby Scott Baudoin, Rayne, LA (US)

(73) Assignee: KLX Energy Services LLC, Houston, TX (US)

( * ) Notice: Subject to any disclaimer, the term of this patent is extended or adjusted under 35 U.S.C. 154(b) by 402 days.

(21) Appl. No.: 14/802,772

(22) Filed: Jul. 17, 2015

(65) Prior Publication Data

US 2016/0024884 A1 Jan. 28, 2016

Related U.S. Application Data

(60) Provisional application No. 62/027,411, filed on Jul. 22, 2014, provisional application No. 62/116,794, filed on Feb. 16, 2015.

(51) Int. Cl.
*E21B 21/10* (2006.01)

(52) U.S. Cl.
CPC ..... *E21B 21/103* (2013.01)

(58) Field of Classification Search
CPC combination set(s) only.
See application file for complete search history.

(56) References Cited

U.S. PATENT DOCUMENTS 8,403,067 B2 * 3/2013 Knobloch, Jr. ..... E21B 34/12 166/334.4

* cited by examiner

*Primary Examiner* — Giovanna C. Wright
*Assistant Examiner* — Ronald R Runyan
(74) *Attorney, Agent, or Firm* — Drinker Biddle & Reath LLP

(57) ABSTRACT

A mechanically activated bypass valve apparatus for allowing fluid being pumped through the pipe or coiled tubing string to be bypassed around a tool string and into the wellbore. Activation of the bypass valve is accomplished by applying weight-on-bit to the apparatus to shear a set of shear screws, allowing the mandrel to move axially relative to the tubular housing. Lowering the pipe string and setting down weigh on bit misaligns fluid bypass ports in the mandrel and housing, thus forcing fluid to continue to flow through the bore of the tool and to the toolstring below the bypass tool. Picking up on the pipe string aligns corresponding ports in the mandrel and housing and allows fluid to flow from the bore of the tool to the wellbore annulus, thus bypassing other tools downhole of the apparatus.

18 Claims, 12 Drawing Sheets

MECHANICALLY ACTIVATED BYPASS VALVE APPARATUS AND METHOD

CROSS REFERENCE TO RELATED APPLICATIONS

This non-provisional United States patent application claims priority to U.S. provisional patent application Ser. No. 62/027,411, filed Jul. 22, 2014 and 62/116,794, filed Feb. 16, 2015, for all purposes. The disclosures of those provisional patent applications are incorporated herein by reference, to the extent not inconsistent with this disclosure.

FIELD OF THE INVENTION

This invention pertains to downhole equipment for oil and gas wells. More particularly, it pertains to a mechanically activated bypass valve apparatus for use on a wellbore pipe string such as a coiled tubing string or pipe string and, more particularly, this invention relates to an apparatus for bypassing flow around a downhole tool string.

BACKGROUND OF THE INVENTION

During the drilling, work over, or plug and abandonment of oil and gas producing wellbores, a variety of down hole tools may be attached to a pipe or coiled tubing string and utilized to perform various functions within the wellbore. Circumstances arise making it desirable to bypass flow around the downhole tool string within the wellbore. The toolstring is often referred to as a bottom hole assembly (BHA). These may consist of a variety of tools. Most frequently it will contain a downhole mud motor. These mud motors have a maximum flow rate rating which must not be exceeded otherwise damage to the mud motor will occur. Thus, if a flow rate is required by an operator which is in excess of the mud motor rating, a portion of the fluid being circulated must be bypassed or diverted to the wellbore. Other circumstances can include lost circulation where lost circulation material (LCM) must be pumped, well control issues, and others of the like which require the flow of fluid within the pipestring to be bypassed around the toolstring or BHA.

In many wells being drilled today, hydraulic fracturing is being utilized to maximize the output of the wells. Hydraulic fracturing, known as fracking, requires multiple stages to be perforated and fractured with a composite bridge plug set between each stage. These composite bridge plugs must be subsequently drilled out using a mud motor and drill bit. These mud motors have flow rate limitations which are oftentimes not high enough to properly clean the drilled debris (bridge plug parts) out of the wellbore. Thus a bypass valve apparatus must be utilized above the mud motor to divert a portion of the fluid being circulated directly into the wellbore and therefore avoiding exceeding the mud motor's flow rating.

There are currently two common types of bypass valves on the market. The first is known as a dual circulation sub (DCS) and can only be activated once with no means to deactivate. The DCS contains a piston which blocks fluid exit ports and is held in place via shear screws. A steel ball must be pumped from surface which lands and seals upon the piston. Pressure is then applied until the shear screws fail and the piston shifts downward, revealing the fluid exit ports. At this point, all fluid being circulated is directed into the wellbore. There is no means to reclose the fluid exit ports.

A second bypass valve device, (known as a PBL® Multiple Activation Bypass System), employs a deformable ball to activate the bypass valve, allowing fluid to travel into the wellbore and around the tool string. A second, metal ball(s) is employed to close the bypass valve off and allow circulation to continue through the tool string. This device allows the operator to perform this function several times while the device is in the wellbore. There are two main disadvantages to this process. The first is that the balls that are pumped down are captured in a "basket", thus preventing further balls to be circulated to devices below this bypass device. This is very important as many downhole tools require ball activation. If two ball activated devices are run simultaneously, the uppermost device must utilize a larger ball for activation than the lower device. In this case, the PBL® disallows balls to continue through it once the first ball has been captured. The second disadvantage is that pumping a ball through a pipe or coiled tubing string is a very time consuming, and thus costly process, especially through a coiled tubing string where the ball must travel through the entire spool of coiled tubing before it even reaches the vertical column within the wellbore, and eventually land in the intended device.

Consequently, there is a need for a mechanically activated bypass valve apparatus which does not utilize any balls to either activate or deactivate and also has the ability for balls to be circulated through this device to activate other tools run lower in the toolstring.

SUMMARY OF THE INVENTION

The present invention is for a new mechanically activated bypass valve apparatus to satisfy the aforementioned needs. The mechanically activated bypass valve apparatus, hereafter referred to as "MABV apparatus" or simply "apparatus" is comprised of a top sub, a tubular housing, a mandrel, a mandrel nut, and a spring. The tubular housing is threadedly attached to the top sub, with the mandrel slidably engaged with the central bore of both the top sub and the tubular housing; the mandrel is prevented from rotating about its longitudinal axis by means of a spline(s) on its outer surface, which mates with a corresponding slot(s) in the tubular housing, or vice versa. Other means to prevent relative rotation between the mandrel and the tubular housing may include pins engaged with slots, balls engaged with slots, keyways, flats or other shapes such hexagonal, etc. These are merely a few of the possibilities for eliminating relative rotation, stated as examples only. The tubular housing includes a port(s) which allows fluid to circulate from the central bore of the mandrel to the outside of the tool string and into the wellbore. Also included are threaded holes for shear screws to be engaged through the wall of the housing and into the mandrel, preventing axial motion until a predetermined amount of weight-on-bit (WOB) is applied. The spring is concentric to the central bore of the housing and is placed between the top sub and the mandrel nut, which is threadedly engaged with the mandrel.

During normal drilling or workover operations, fluid, which can be a liquid, gas, or a combination thereof, is circulated through a downhole tool string. In the event that operators need to bypass the tool string downhole of the MABV apparatus, WOB must be applied to shear the shear screws, and allow the mandrel to move axially relative to the housing. The operator will then lift up on the pipe string, whereby the mandrel will then shift away from the tubular housing, so that the port(s) in the mandrel aligns with the port(s) in the tubular housing, allowing fluid to flow out of the MABV apparatus. The port(s) will remain aligned thus bypassing fluid to the wellbore until the operator sets down WOB upon the toolstring. At this point the mandrel moves towards the tubular housing thus closing the bypass ports.

In the event that the mud motor begins to stall during a drilling operation, this invention will allow an operator to relieve the stall without having to shut down the pump, or risking backlash which might compromise (back off or loosen) the threaded connections between tools downhole of the apparatus, as is currently common. If a stall occurs, the toolstring can be lifted slowly, thereby slowly opening the bypass ports, and allowing fluid to flow out of the tool string without entering the motor, dissipating pressure and relieving the stall. The operator is then free to again set down WOB upon the toolstring, closing the ports, and normal drilling will resume.

This invention can also be used as a downhole shock absorber, if such tools as vibrators or perforating (TCP) guns are included in the tool string and vibrator and or impact absorption is required. Once the shear screws have been sheared, the mandrel is free to travel axially with respect to the tubular housing, and any axial force occurring in the tool string will be absorbed by the spring and the sealed air chamber of the apparatus, thus dissipating impact or vibrational loads thereby eliminating damage or fatigue to tools in the BHA.

Another unique advantage of this apparatus is that during drilling operations, with WOB being applied, the MABV apparatus applies a constant downward force upon the mud motor and thus the object or formation being drilled. Generally, drilling toolstrings are very rigid. So, when an operator sets down WOB and the drill bit removes a portion of the object being drilled and fluid washes it uphole, the WOB decreases (called drilling off) because the pipe has not moved. Thus to maintain the WOB, the operator must again lower the pipe into the wellbore thereby setting down more WOB. This process must be repeated constantly to maintain a consistent (or consistent as possible) WOB. The MABV apparatus however has several inches of travel, with the mandrel being preloaded by both a spring and compressed air (or other compressible fluid) chamber. So, the MABV apparatus always applies a downward force (WOB) within the stroke limitations of the MABV apparatus. For example, if an operator sets down enough WOB to completely close the MABV apparatus (where the shoulder of the mandrel encounters the end of the tubular housing), the operator can keep the pipestring in the same location as the MABV apparatus applies a WOB to the mud motor for several inches. This allows the operator to keep the pipe in one place for much longer periods of time while the MABV apparatus applies the WOB. For example with 2⅞" OD tools, this WOB can range from 500 lbs. to 2500 lbs. The operator can however set down as much WOB as he desires (within pipe or coil tubing limitations) without detrimentally affecting the MABV apparatus. These values will range dramatically from the smaller 1 11/16" mud motors to the larger 12" mud motors. This MABV apparatus provides a much more consistent and efficient drilling process while requiring far less operator efforts.

Yet another use for the MABV apparatus is the deposition of acid across perforations in a wellbore during production or workover operations. In order to accomplish this, it is necessary to seal off the upper toolstring from the mud motor on the lower end, as acid destroys the elastomer lining of the motor, usually by means of a circulated ball. Currently, this process is performed using two methods. One is the use of a dual circulating sub, which has ports that open under a preset pressure, but can only be activated once with no means to deactivate and therefore must be pulled out of the wellbore and reset after each deposition of acid. The second method is the use of the aforementioned PBL®, which can be activated several times, but requires a second set of balls to deactivate between uses. Use of the MABV apparatus, with an attached acid sub, would greatly reduce the time required for this process. When ready to deposit acid, operators will pump a ball down, which will seal against a deformable plastic seat inside the acid sub, thus sealing off the apparatus from the motor. Then, operators need only lift off WOB, and open the bypass ports, flooding the wellbore with acid. When acid placement is complete, operators will again reapply WOB, closing the bypass ports. Pressure is then applied against the ball, forcing it through the deformable plastic seat and into the basket below it, clearing the apparatus for normal use.

DESCRIPTION OF THE EMBODIMENTS

Figure 1:
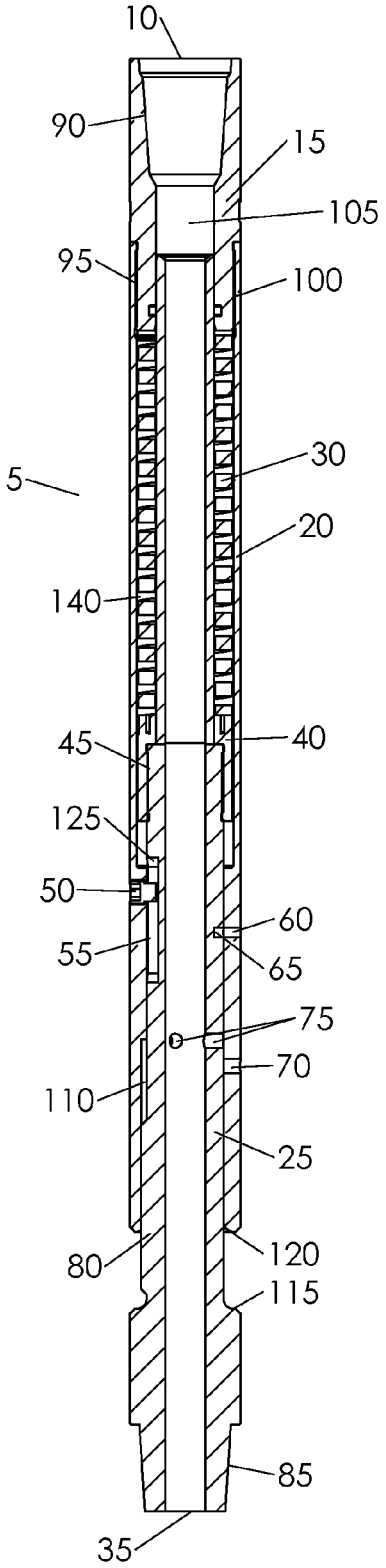
FIG. 1 is a longitudinal cross-sectional view of the MABV apparatus with shear screws installed.

FIG. 1 shows an embodiment of the MABV apparatus (5) of the present invention utilized to provide a means of bypassing fluid around a tool string and into a wellbore, should such a need arise. The MABV apparatus (5) is configured for threadable attachment to a pipe or coil tubing string deployed in a wellbore having a central bore through which fluid may be introduced. The MABV apparatus (5) is positioned on the pipe string so that it extends longitudinally along the axis of the pipe string to which it is threadedly attached.

In the configurations shown in FIGS. 1, 2, 3, 4, and 5, the MABV apparatus (5) is comprised of a top sub (15), a housing (20), a mandrel (25), a spring (30), and a mandrel nut (40). The upper end of the apparatus (5) is referenced by (10) and the lower end by (35). Apparatus (5) is configured for threadable attachment to a pipe string by means of an upper threaded connection (90) of top sub (15). A lower threaded connection (85) is configured on mandrel (25) for threadable attachment to a bottom hole assembly (BHA). The top sub (15) and mandrel (25) both contain central bores which are in communication with the central bore of the pipe string. The top sub (15) and housing (20) are threadedly connected via threaded connection (100) of central housing (20) and threaded connection (95) of top sub (15). Mandrel (25) is aligned axially with the tool string and is concentric to central bore (105) of top sub (15), and is allowed to translate (or move longitudinally) freely, relative to housing 20, but not to rotate relate to housing 20, as constrained by the interaction of a set of splines (80) and their mating slots (110). The mandrel nut (40) is concentric and threadedly connected with the mandrel (25) via threaded connection (45) and serves to retain mandrel (25) within housing (20).

FIG. 1 illustrates the components of MABV apparatus (5) in the fully deactivated position, with shear screw(s) (60) intact and engaged with mating pocket(s) (65) on the outer surface of mandrel (25). In this position, bypass port(s) (70) are closed off allowing the operator to circulate through the toolstring while tripping into the hole. This is mandatory when running a mud motor because mud motors contain rubber which must be cooled with fluid while entering a wellbore. If a mud motor is not sufficiently cooled, overheating causes the rubber to swell and can cause the motor to lock up. If circulation through the toolstring is not necessary while tripping into the wellbore, the shear screw (s) (60) may be left out, which will allow fluid to exit the MABV into the wellbore.

Figure 2:
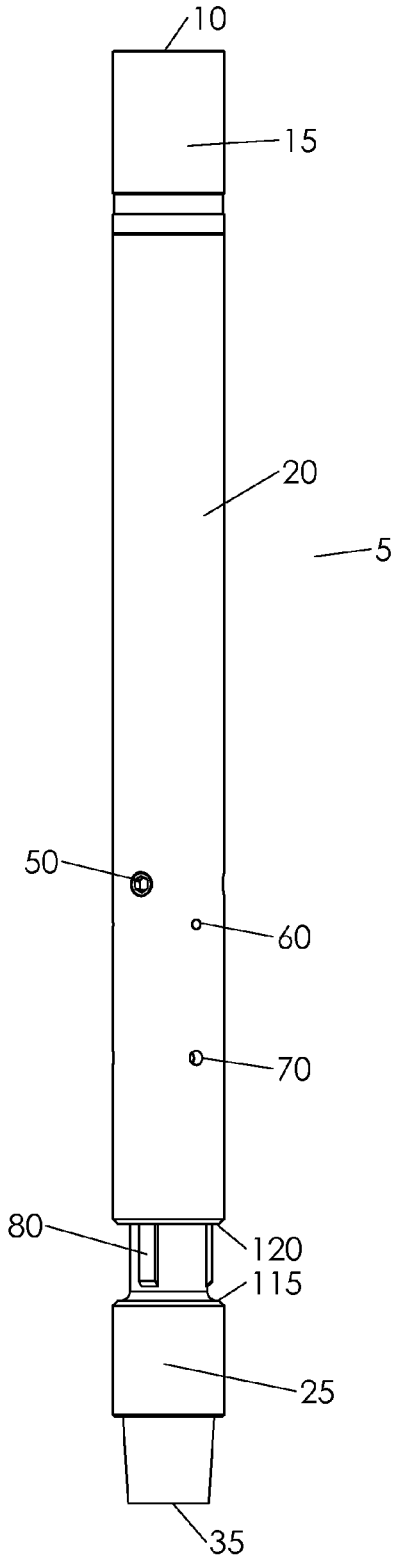
FIG. 2 is a longitudinal view of the MABV apparatus with shear screws installed.

FIG. 2 is a longitudinal view of the outside of the MABV apparatus (5), and it better shows the set of splines (80) that prevent mandrel (25) from rotating relative to housing 20, as well as retaining pin(s) (50) and shear screws (60) and the bypass port(s) (70) on the exterior of central housing (20).

Figure 3:
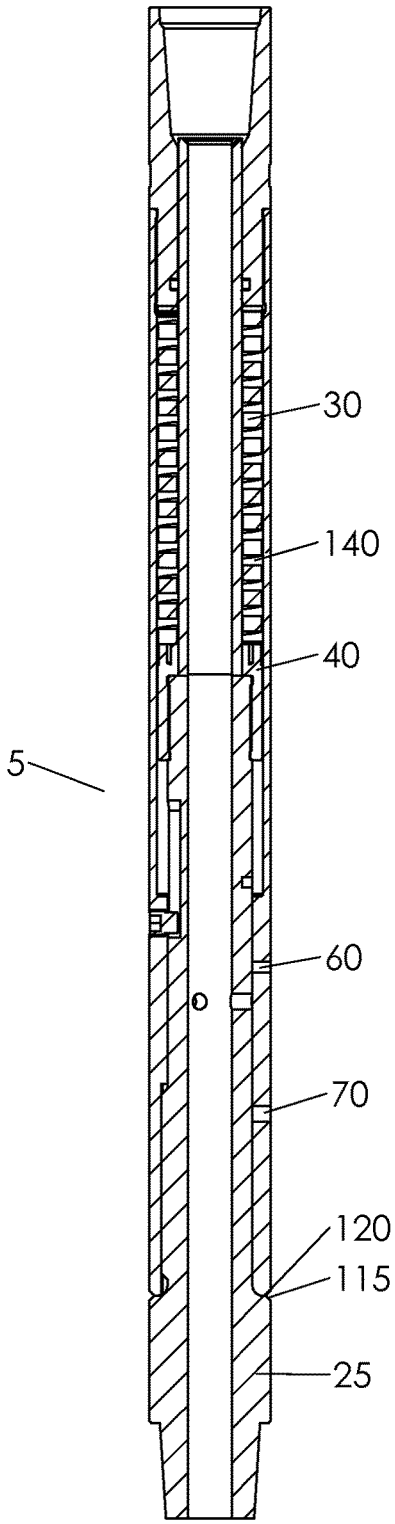
FIG. 3 is a longitudinal cross sectional view of the MABV apparatus shown in FIG. 1, showing the apparatus with weight-on-bit applied and the mandrel fully engaged with the housing.

FIG. 3 shows the MABV apparatus (5) with WOB being applied, so that the shear screws (60) have been sheared, and the bypass port(s) can be activated at will, but are still closed, allowing fluid to flow through the central bore of the MABV apparatus (5), so that drilling can continue. In this position, the mandrel (25) is fully engaged with the central housing (20), and shoulder (115) of the mandrel (25) is resting against shoulder (120) of the central housing (20).

Figure 3A:
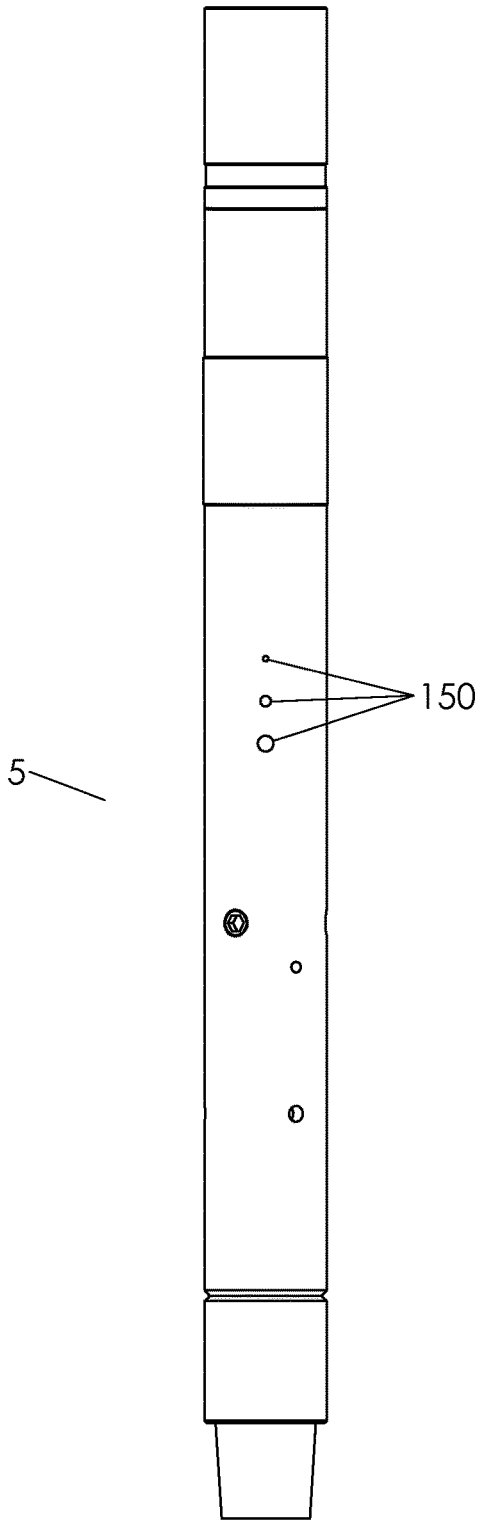
FIG. 3A is a longitudinal view of the MABV apparatus with metering port(s).

A second embodiment of the MABV apparatus of FIG. 3 contains metering port(s) (150) as illustrated in FIG. 3A. These metering port(s) (150) regulate wellbore fluid entering and exiting sealed chamber (140). The metering of fluid in this manner dampens the motions of the spring to provide smoother stroking of mandrel (25) into and out of tubular housing (20). This is similar to the metering valve (or metering principle) of a vehicle shock absorber, except this MABV apparatus meters wellbore fluid rather than oil.

Figure 4:
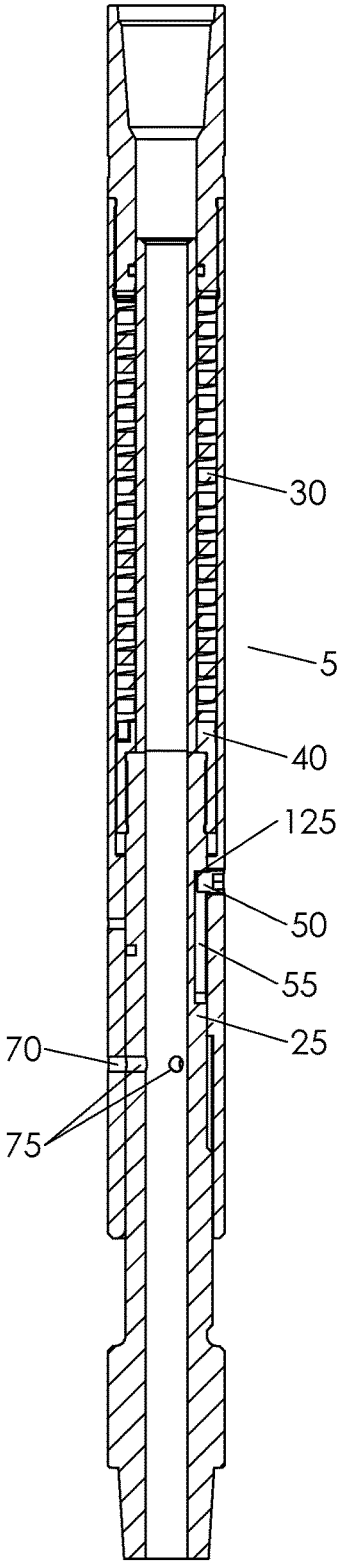
FIG. 4 is a longitudinal cross sectional view of the MABV apparatus shown in FIG. 1, showing the mandrel in the activated or bypass position.

FIG. 4 shows the MABV apparatus (5) in its operating position. In order to activate the MABV apparatus (5) the operator must lift up on the pipe string, so that the spring (30) will force the mandrel (25) downwards until shoulder (125) of slot (55) will rest against retaining pin(s) (50), and the bypass port(s) (70) align with the corresponding port(s) (75) in the mandrel (25) and fluid is free to flow into the wellbore.

Figure 5:
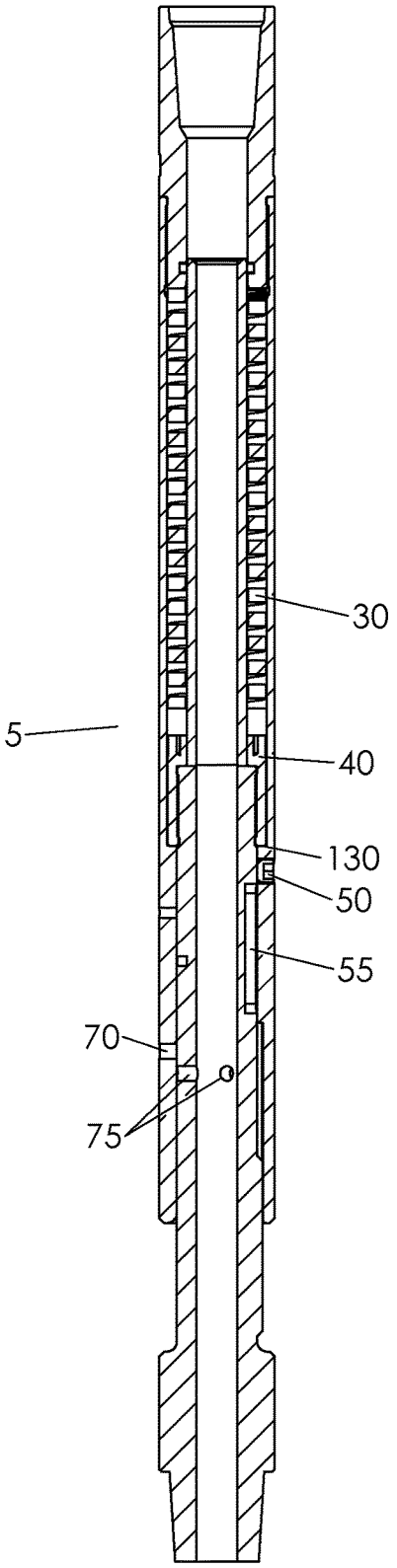
FIG. 5 is a longitudinal cross section view of the apparatus with the retaining pins sheared, and the mandrel in its overextended position.

While exiting or "tripping out" of the wellbore, the toolstring and or drill bit may become lodged, with the MABV apparatus (5) is in the bypass position. When this occurs, the operator may desire to again utilize the mud motor to backream or drill the object preventing him from exiting the wellbore. But at this time, the spring (30) is forcing the mandrel (25) to be fully extended, thereby aligning bypass ports (70) and (75), allowing fluid to flow out of the MABV apparatus (5), and thus not activating the mud motor below it. In order to close bypass ports (70), the operator can apply upwards axial force far in excess of normal operating axial forces to shear the retaining pin(s) (50). This allows the mandrel (25) to move downwards relative to the tubular housing (20) thereby closing off bypass port(s) (70) and thus re-establishing circulation through the mud motor to drill away the obstruction. FIG. 5 shows the MABV apparatus (5) in this overextended position. The mandrel nut (40) seats against shoulder (130) of central housing (20) to retain mandrel (25) within tubular housing (20).

Figure 6A:
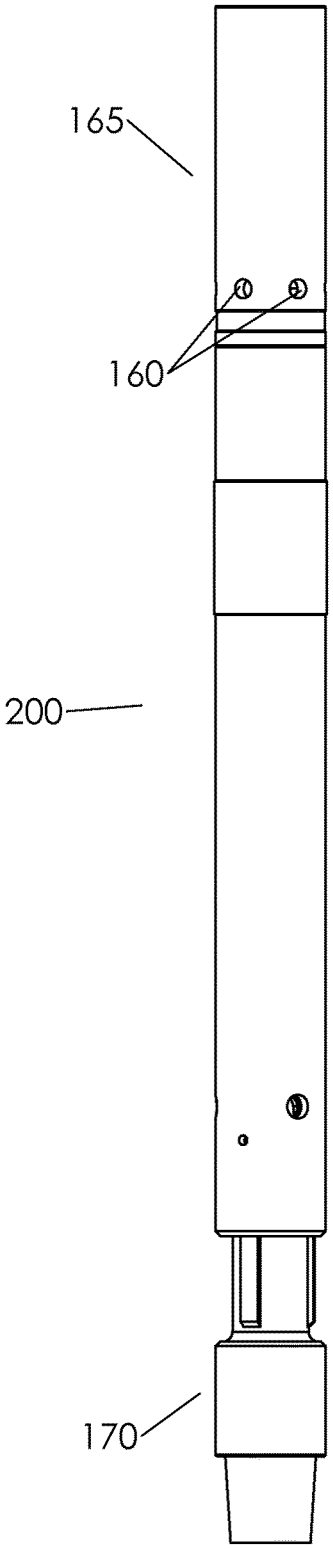
FIG. 6A is a side view of a third embodiment of the apparatus, with bypass ports in the top sub.
Figure 6B:
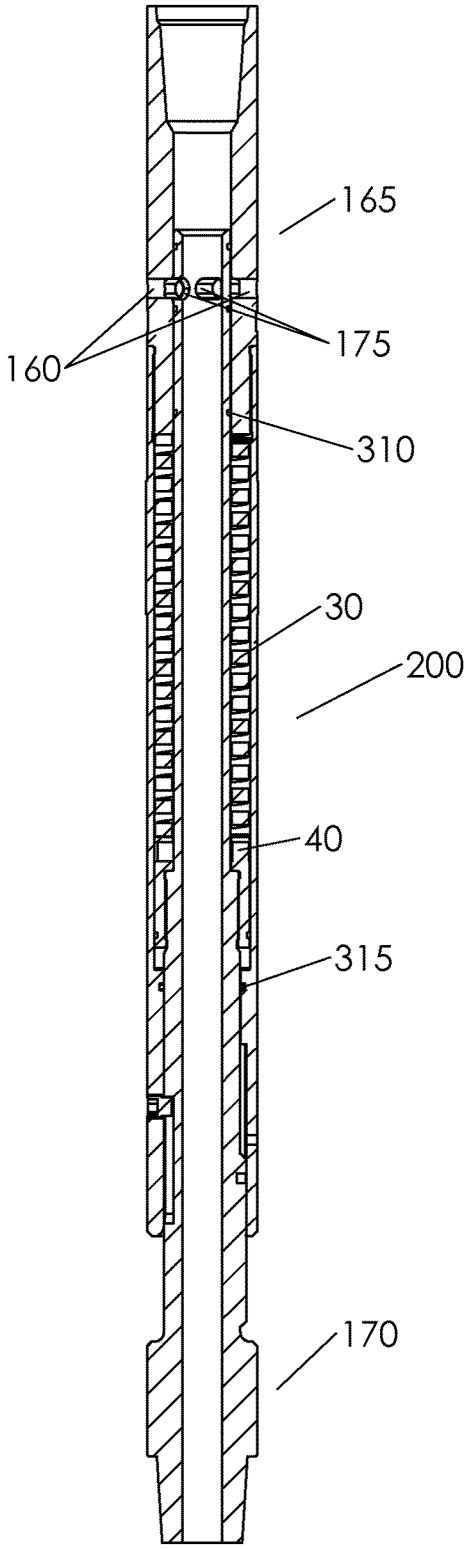
FIG. 6B is a cross-sectional view of the apparatus of FIG. 6A.

A third embodiment of apparatus (5) of FIG. 1 comprises bypass port(s) (160) through top sub (165) of apparatus (200) and the corresponding bypass port(s) (175) of mandrel (170), shown in FIGS. 6A and 6B. In order to use apparatus (200), operators will lift the tool string off the object or formation being drilled, allowing spring (30) to force mandrel (170) downward, aligning bypass port(s) (160) of top sub (165) with bypass port(s) (175) of mandrel (170), allowing for the flow of fluid out of the tool and into the surrounding wellbore, similar to the configuration shown in FIG. 17. Embodiment (200) may also contain sealing element(s) (310) on mandrel (170) and sealing element(s) (315) in tubular housing (20). These sealing elements (310) and (315) may be o-rings, chevron packing, machined seals, spring energized seals, or any other type of seal to retain internal lubricants while preventing wellbore fluid from entering apparatus.

Figure 7:
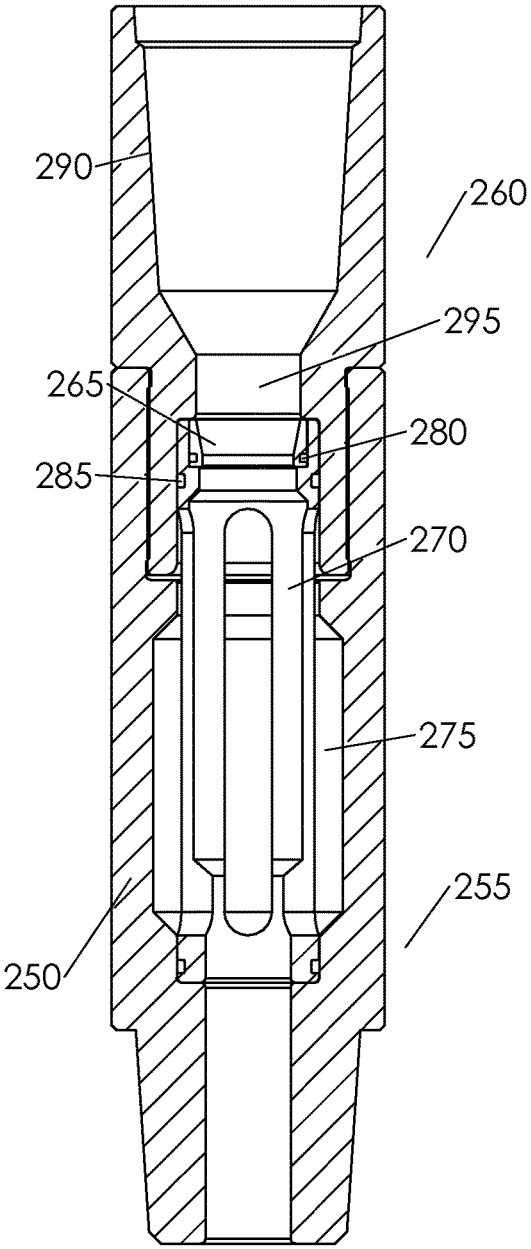
FIG. 7 is a section view of the attachable acid subapparatus.
Figure 8:
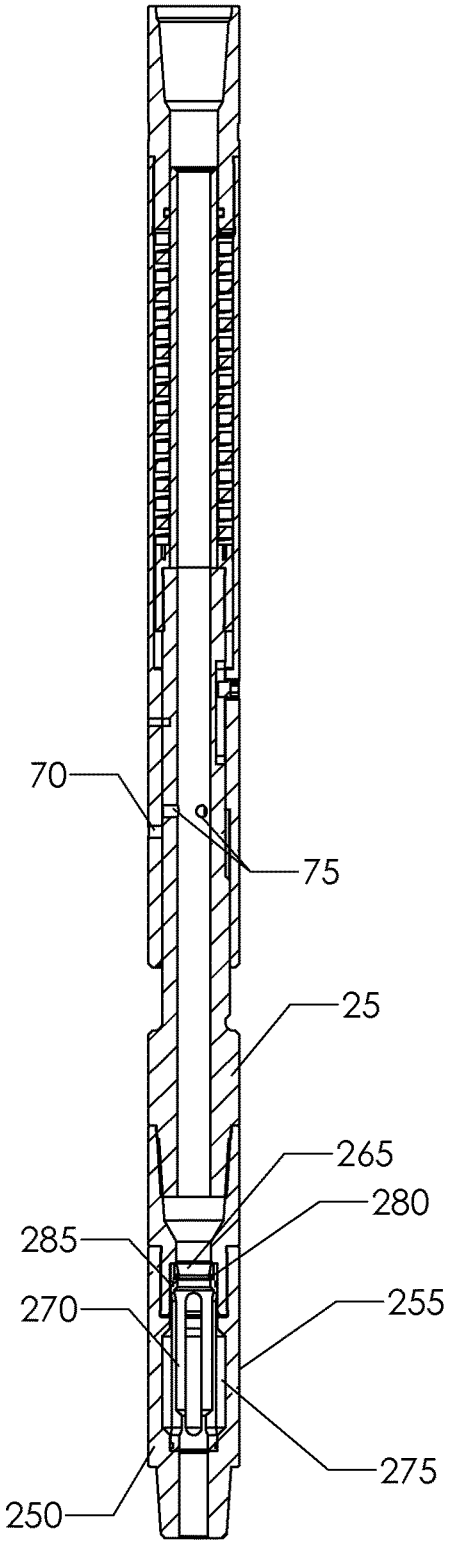
FIG. 8 is a section view of the preferred embodiment of the MABV apparatus with attached acid sub apparatus.

A possible addition to apparatus (5) is acid sub apparatus (250) of FIG. 7. Said sub apparatus is comprised of top sub (260), bottom sub (255), ball catcher (270), and seat (265). Bottom sub (255) is threadedly attached to top sub (260), with ball catcher (270) concentric with the central bore (295) of top sub (260), and seat (265) placed inside ball catcher (270). The seat (265) is preferably made of elastomeric material, preferably PEEK (polyether ether ketone), so that it is able to deform under a known load. Sub apparatus (250) is threadedly attached to the lower end (35) of mandrel (25) of FIG. 1 by threaded connection (290) of top sub (260), as shown in FIG. 8. To use subapparatus (250), operators will pump a steel ball down the pipe or coiled tubing string, which will land on seat (265), sealing off apparatus (5) from the mud motor below it, allowing for deposition of acid into the wellbore, by means of the use of apparatus (5) as detailed above. O-ring seals (280) and (285) prevent the flow of fluid around ball catcher (270). When the need for sub apparatus (250) to be sealed has passed, operators will set down WOB, closing off apparatus (5) from the wellbore, and apply pressure to the steel ball on seat (265), which will then deform slightly, allowing the steel ball to extrude through and into ball catcher (270) directly below it, and return to its original shape. Spent steel balls are held in ball catcher (270), but do not impede the flow of fluid through bottom sub (255), as fluid flows through slots (295) and into bore (275) of bottom sub (255), around any balls in ball catcher (270). Alternatively, seat (265) may be made of steel and the ball made be made of an elastomeric material or material capable of deforming, such as PEEK (polyether ether ketone).

Figure 9:
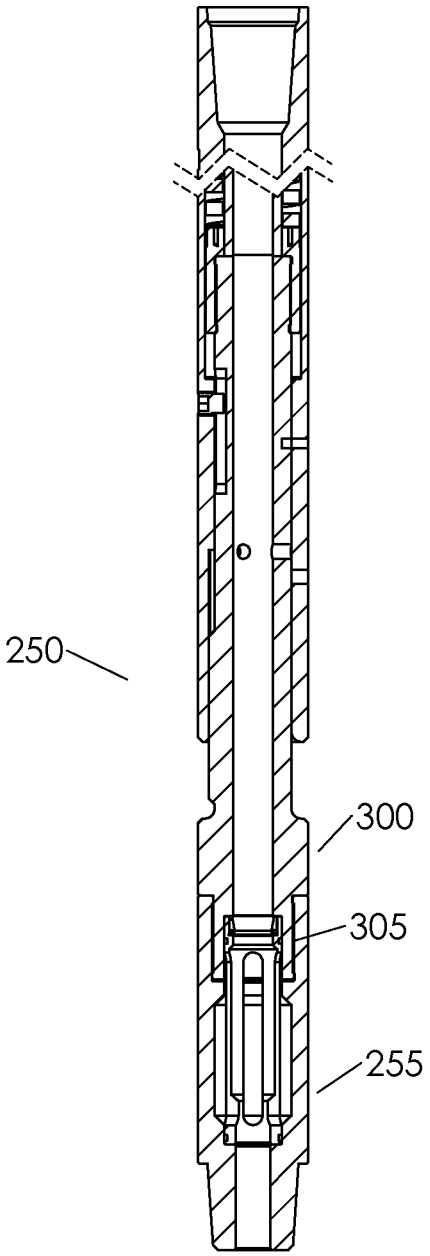
FIG. 9 is a section view of an alternate embodiment of the MABV apparatus, with acid sub apparatus attached.
Figure 10:
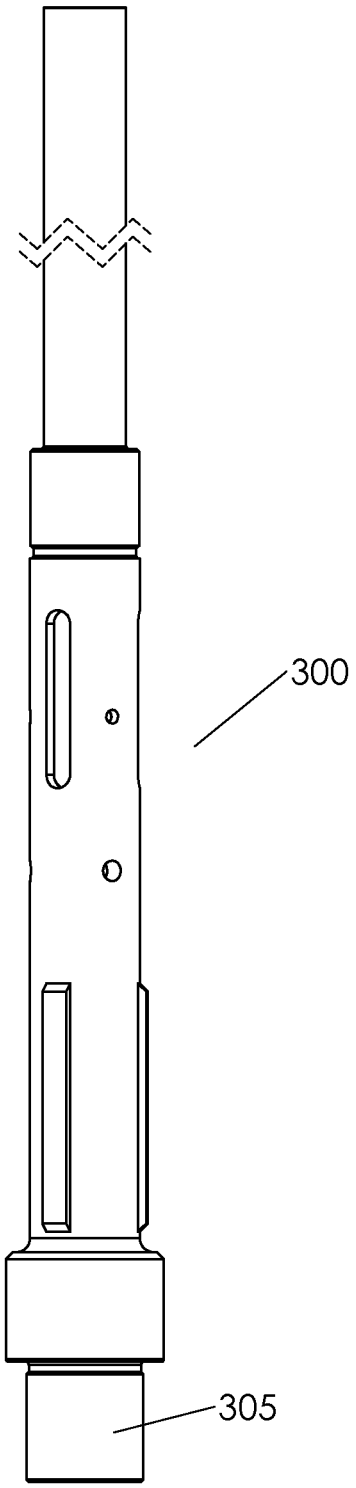
FIG. 10 is a side view of the alternate embodiment of the mandrel of the apparatus of FIG. 9.

A second embodiment of apparatus (250), shown in FIG. 9, comprises mandrel (300) of FIG. 10, with threaded connection (305) connecting directly to bottom sub (255) without the need for top sub (260). Such a configuration would work the same as that shown in FIG. 8.

Figure 11:
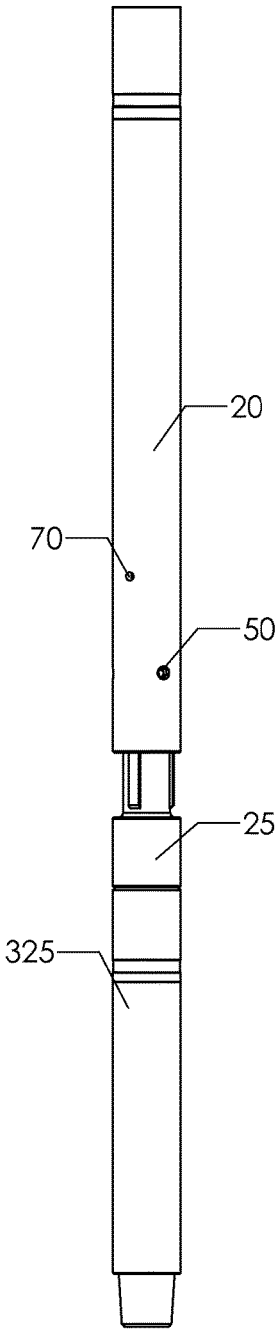
FIG. 11 is a side view of the MABV apparatus attached to a downhole vibration device.

FIG. 11 illustrates the MABV apparatus (5) being used in conjunction with a downhole vibration device (325), often referred to as "Extended Reach Tool". These downhole vibration devices (325) are well known in the art. It is illustrated as attached to the lower end of the MABV apparatus (5) but could be attached to the upper end depending on the application.

Figure 12:
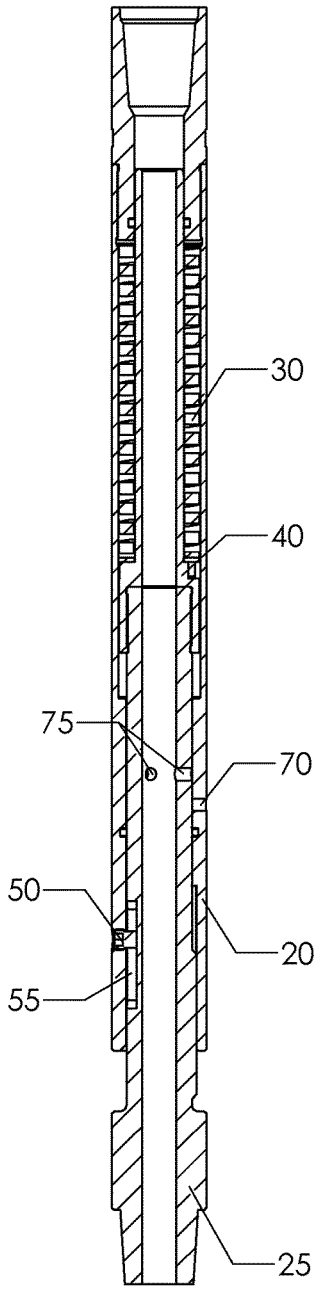
FIG. 12 is a longitudinal cross sectional view of a second embodiment of the MABV apparatus shown in FIG. 1.

A second embodiment of the MABV apparatus (5) is shown in FIG. 12 where the retaining pin(s) (50) is located closer toward the lower end of the tubular housing (20).

Figure 13:
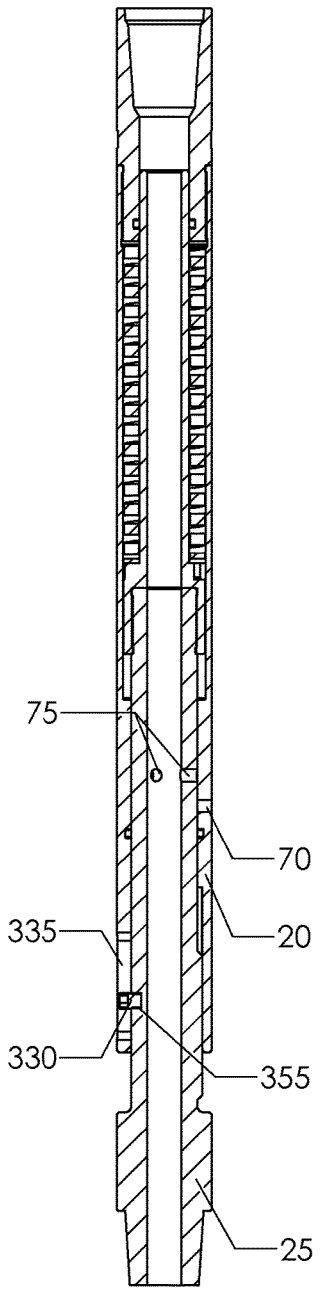
FIG. 13 is a longitudinal cross sectional view of a third embodiment of the MABV apparatus shown in FIG. 1.

Yet a third embodiment of the MABV apparatus (5) is illustrated in FIG. 13 whereby the retaining pin (355) is threadedly engaged with mandrel (25) and operates in slot (335) in housing (20). It is readily understood that this embodiment (in essence) reverses the positioning of the retaining pin and slot.

Figure 14:
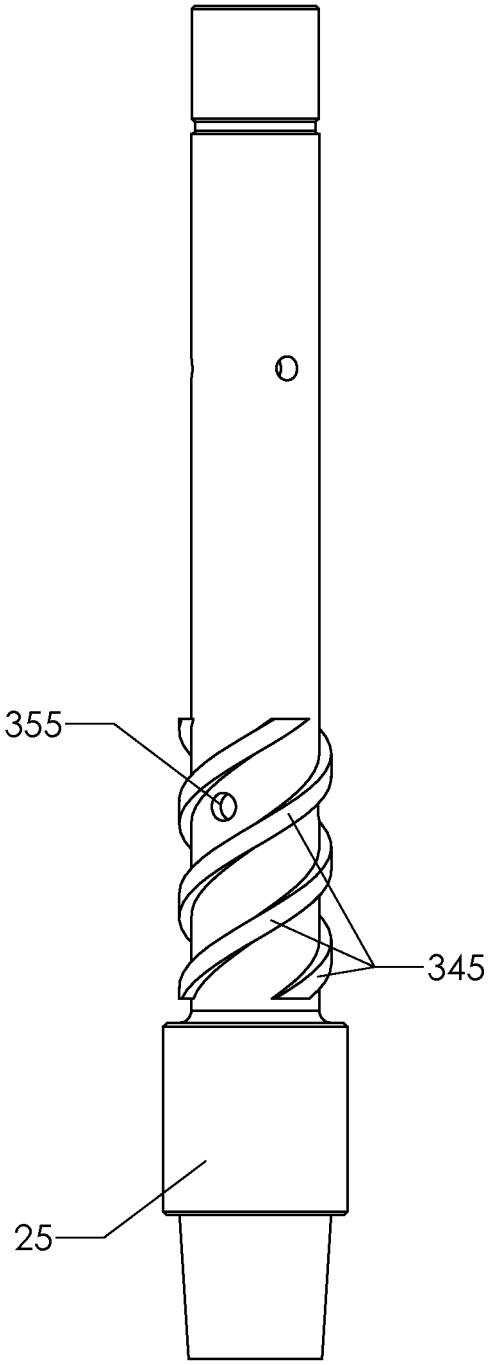
FIG. 14 is a longitudinal cross sectional view of a third embodiment of the mandrel apparatus shown in FIG. 1.

FIG. 14 illustrates a third embodiment of mandrel (25) which incorporates external helical splines (345) on mandrel 25, engaging mating helical grooves in the inner wall of housing 20. It can be readily understood that the mating helical splines and grooves cause the mandrel (25) to rotate relative to the housing (20) as longitudinal movement between the mandrel and the housing occurs, such as when weight on bit (WOB) is added or subtracted. This embodiment is also useful in reducing downhole motor sticking situations, as downhole motor torque will tend to rotate mandrel 25 relative to housing 20, which will in turn tend to pull the motor off bottom and relieve sticking. As in earlier described embodiments, a retaining pin 355 limits travel of mandrel 25 relative to housing 20.

Figure 14A:
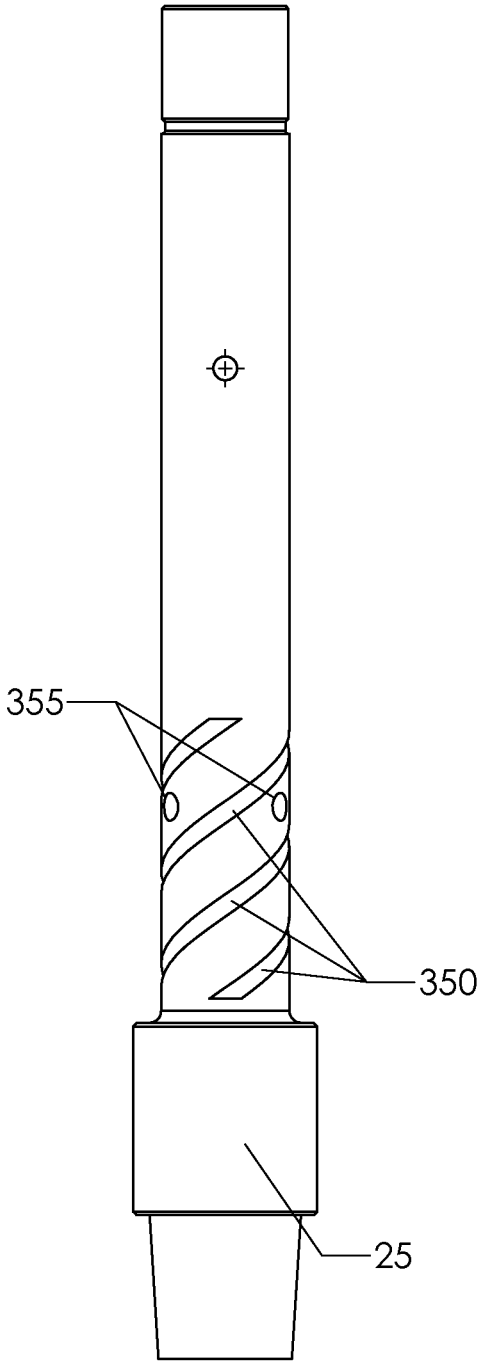
FIG. 14A is an alternate embodiment of the mandrel apparatus shown in FIG. 14.

FIG. 14A is another alternate embodiment of mandrel (25), similar to that shown in FIG. 14, but where helical grooves (350) in mandrel 25 are utilized in lieu of external splines on mandrel 25. These grooves (350) would engage some element within housing 20 which would cause the desired rotational/longitudinal movement between mandrel 25 and housing 20, for example a mating internal spline within housing 20, balls disposed in grooves 350 and corresponding grooves in the inner wall of housing 20, one or more pins protruding from the inner wall of housing 20 into grooves 350, or similar means.

Figure 15:
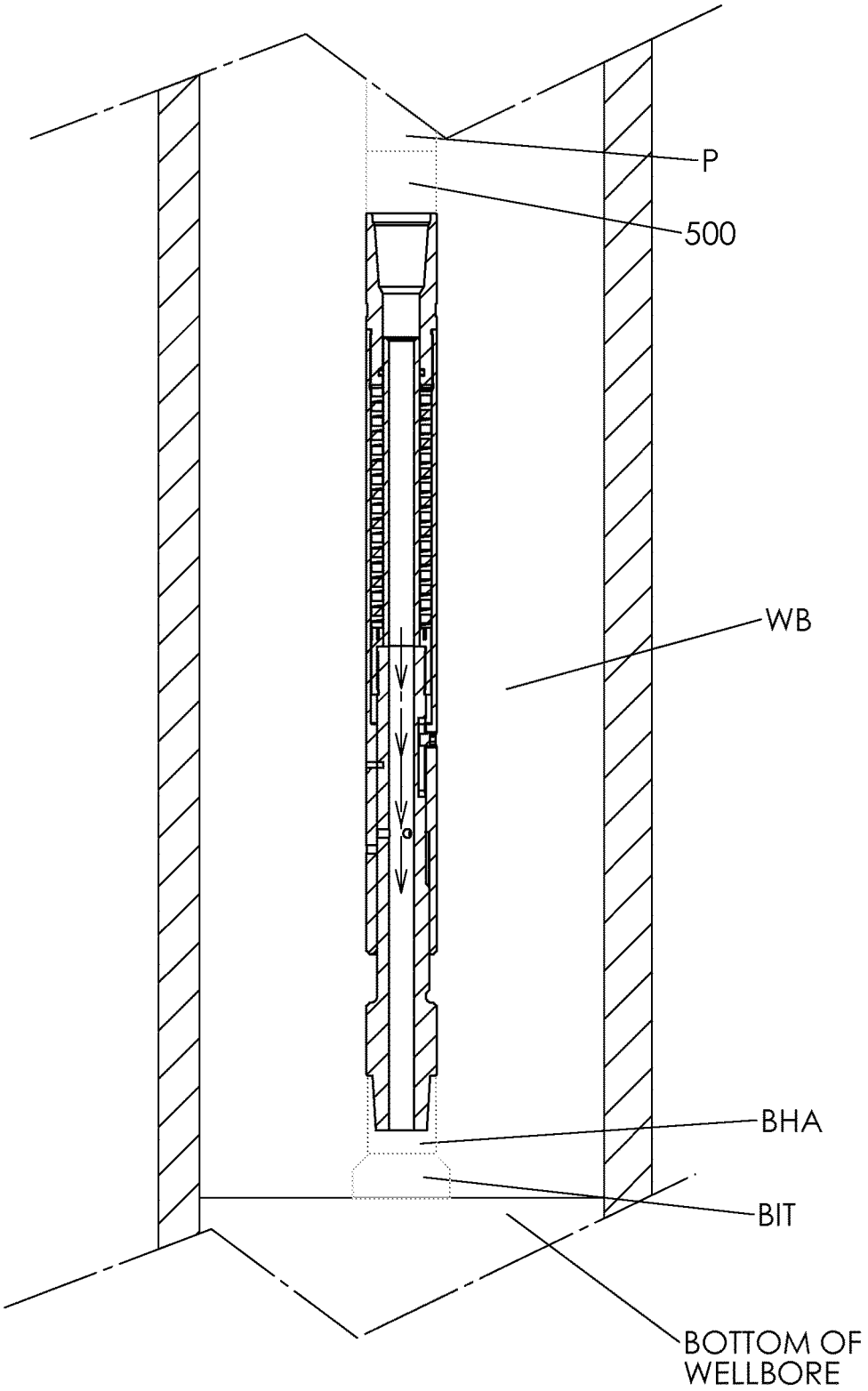
FIG. 15 is a view of the apparatus in a wellbore as part of a downhole tool string with shear screws installed, and the bypass ports closed.

FIG. 15 shows the MABV apparatus (5) as part of a downhole tool string in a wellbore (WB) with a bottom hole assembly (BHA) attached. The MABV apparatus (5) is attached to the pipe or coiled tubing string (P) via upper threaded connection (500). The MABV apparatus (5) is shown with the shear screw(s) (60) installed thus with ports closed, thereby allowing fluid to flow down the central bore of the MABV apparatus (5), as shown by the arrows and into the toolstring.

Figure 16:
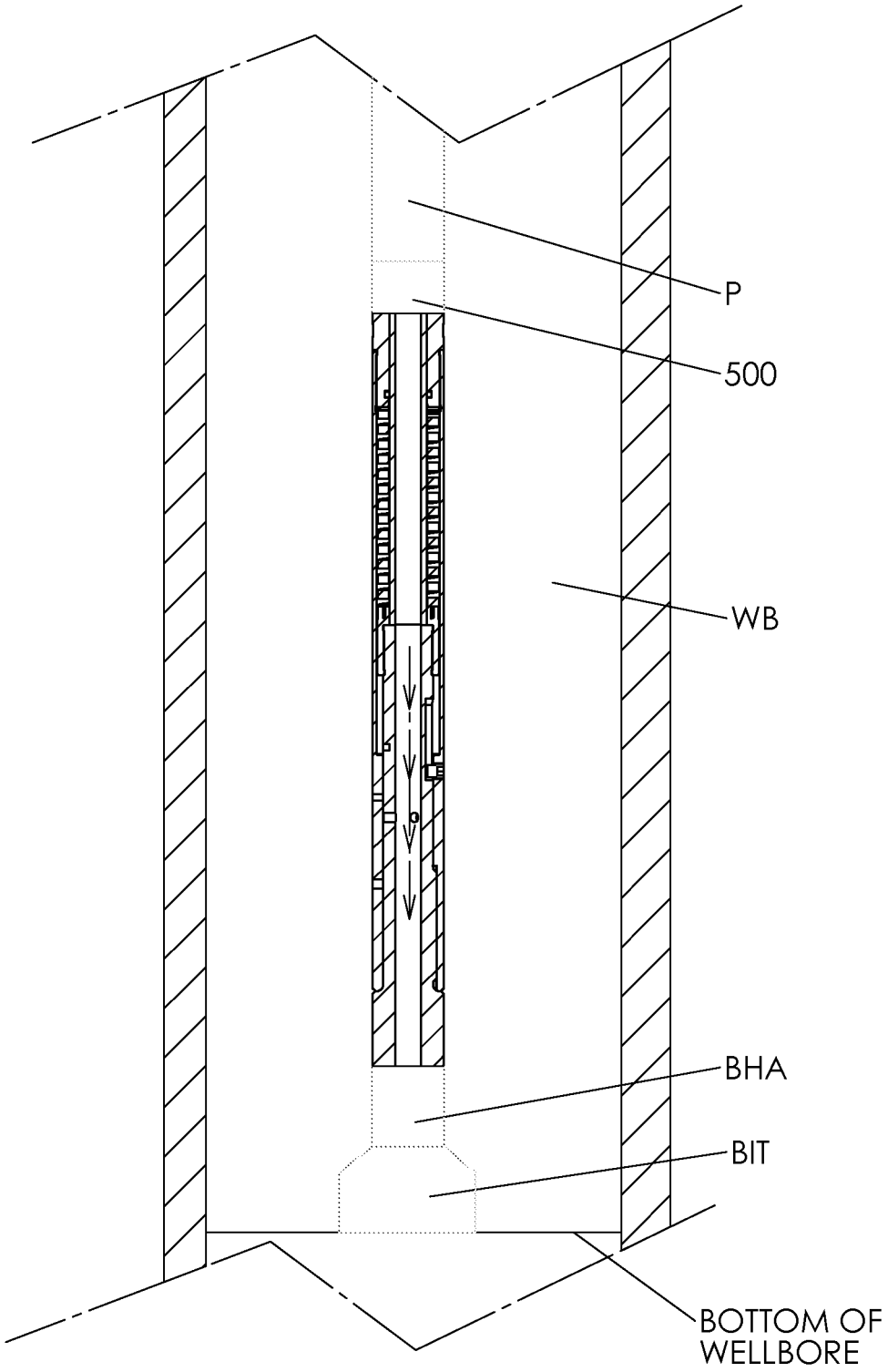
FIG. 16 is a view of the apparatus in a wellbore as part of a downhole tool string with weight-on-bit applied, and the bypass ports closed.

FIG. 16 shows the MABV apparatus (5) as part of a downhole tool string in a wellbore (WB) with a bottom hole assembly (BHA) attached. The MABV apparatus (5) is attached to the pipe or coiled tubing string (P) via upper threaded connection (500). The MABV apparatus (5) is shown with WOB applied thus with ports closed, thereby allowing fluid to flow down the central bore of the MABV apparatus (5), as shown by the arrows and into the toolstring or mud motor.

Figure 17:
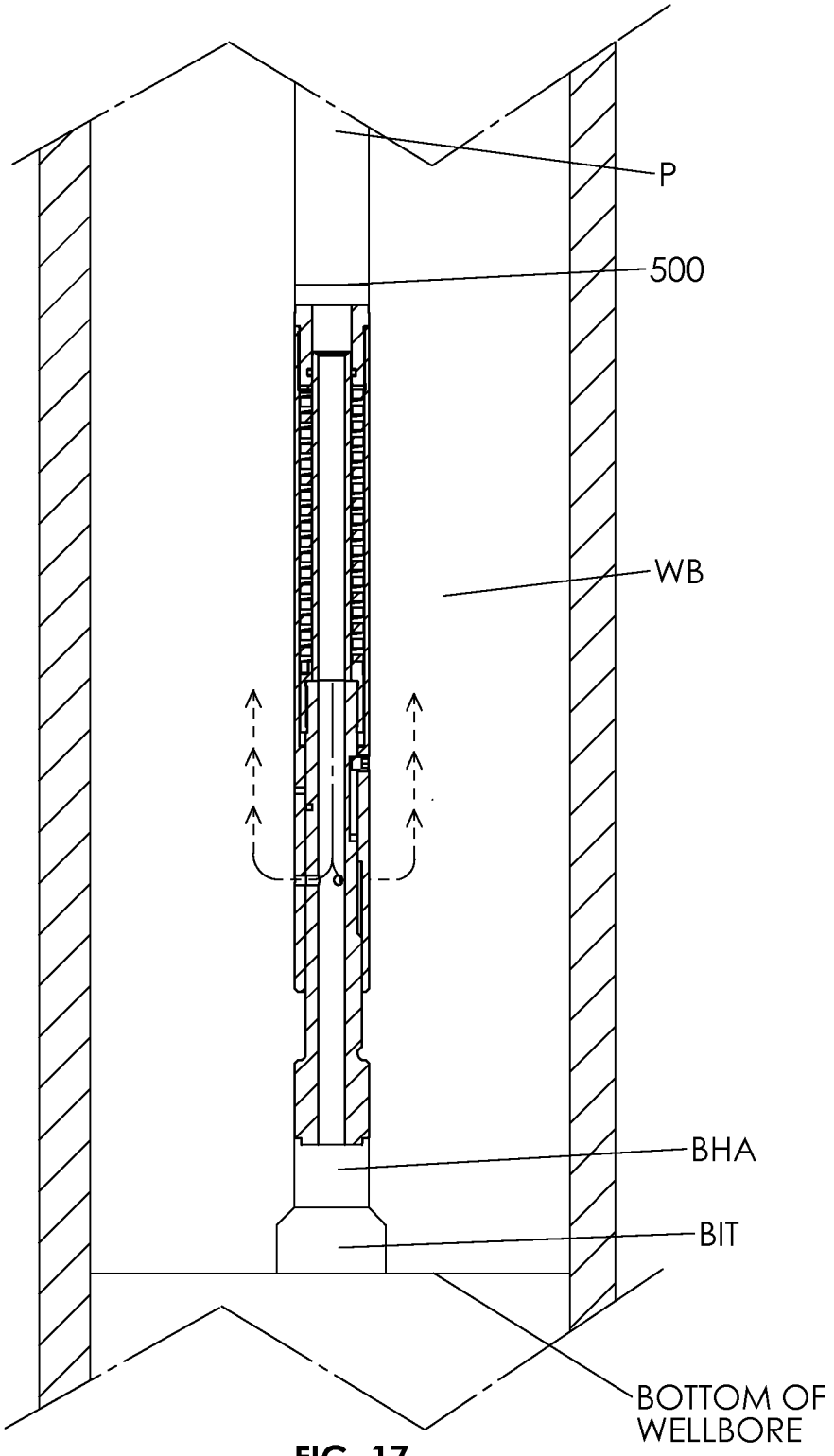
FIG. 17 is a view of the apparatus in a wellbore as part of a downhole tool string with no weight-on-bit applied, and the bypass ports are open.

FIG. 17 is a second view of the MABV apparatus (5) as part of a downhole tool string with attached bottom hole assembly (BHA). The MABV apparatus (5) is attached to the pipe string (P) by upper threaded connection (500). In this position, no WOB is being applied and the toolstring is off bottom, thus the port (s) (60) are open and the MABV apparatus (5) is bypassing fluid in to the wellbore (WB), as shown by the arrows.

Figure 18:
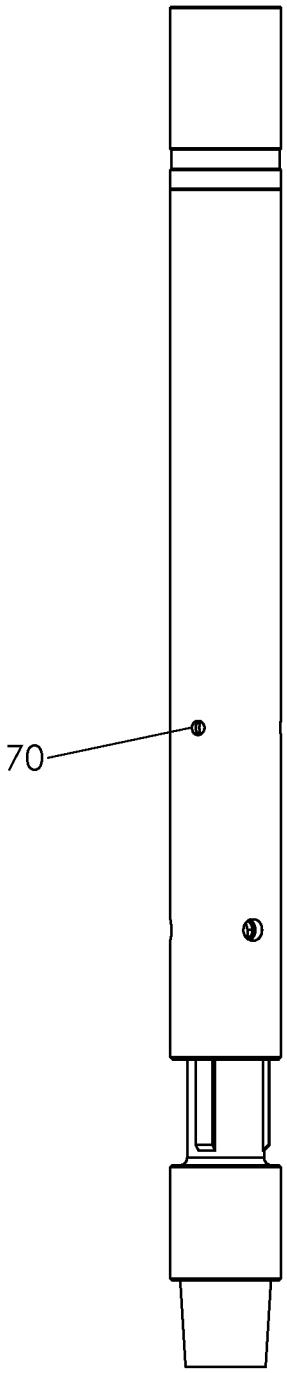
FIG. 18 is a side view of a fourth embodiment of the MABV apparatus shown in FIG. 1.
Figure 19:
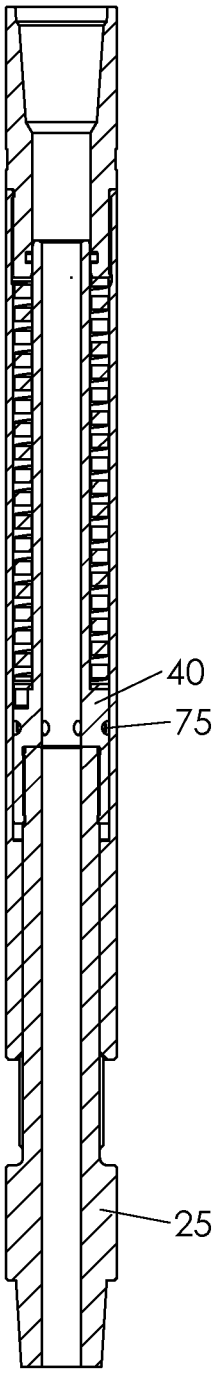
FIG. 19 is a longitudinal cross section view of the MABV apparatus shown in FIG. 18.

FIG. 18 and FIG. 19 illustrate a fourth embodiment of the MABV apparatus (5) whereby the bypass ports (75) are located on mandrel nut (40) rather than mandrel (25). In other respects this embodiment operates as the above-described embodiments.

CONCLUSION

While the preceding description gives a number of details regarding several embodiments of the apparatus (and methods of its use), embodying the principles of the present invention, it is to be understood that same are offered by way of example, and not limitation. For example, dimensions and materials may be varied to suit particular settings; the apparatus may be used in various operational settings in addition to those described herein, etc.

Therefore, the scope of the invention is not to be limited by the examples given above, but by the appended claims and the legal equivalents thereof.

I claim:

1. A bypass tool, for placement downhole in a wellbore, comprising:

an elongated central housing having a bore therethrough, said central housing comprising one or more bypass ports through a wall thereof, and having one or more internal grooves at a lower end thereof;

an elongated mandrel disposed in said bore of said central housing, said mandrel having a bore therethrough and one or more bypass ports through a wall thereof, said mandrel comprising a spline which engages said one or more internal grooves in said central housing and prevents relative rotation between said mandrel and said housing;

a spring disposed in said central housing, biasing said mandrel out of a lower end of said central housing;

a first set of shear screws connecting said central housing and said mandrel and holding said mandrel in a first extended position, wherein said bypass ports in said central housing and said mandrel are not aligned and fluid flow therethrough is prevented;

one or more shearable retaining screws engaged with said central housing and extending into said bore thereof, wherein when said shear screws are sheared and said mandrel is biased axially outwardly from said central housing, said retaining screws engage a shoulder on said mandrel and prevent said mandrel from further downward movement out of said central housing beyond a second extended position, said bypass ports in said central housing and said mandrel being aligned in said second extended position, permitting fluid flow to flow from said bore of said mandrel outside of said central housing;

a mandrel nut on said mandrel, engageable with a shoulder within said central housing, whereby when said shearable retaining screws are sheared said mandrel may be biased out of said central housing beyond said second extended position to a third extended position, wherein said bypass ports in said central housing and said mandrel are not aligned and fluid flow therethrough is prevented.

2. The apparatus of claim 1, wherein said central housing comprises one or more metering holes therethrough, through which fluid may enter and leave a chamber formed between said mandrel and said central housing.

3. The apparatus of claim 1, wherein said central housing further comprises top and bottom subs attached to the upper and lower ends thereof, said top and bottom subs comprising threaded connections for attachment to a pipe string.

4. The apparatus of claim 1, wherein said bypass ports in said mandrel are positioned proximal an upper end thereof, and said bypass ports in said housing are positioned in said top sub.

5. The apparatus of claim 1, further comprising a shoulder on said mandrel which limits movement of said mandrel into said central housing.

6. The apparatus of claim 1, further comprising an acid sub connected to a lower end of said central housing, said acid sub comprising an elongated member having a bore therethrough, a resilient ball seat disposed in said bore, and a ball catcher disposed below said ball seat and adapted to receive balls after passage through said ball seat.

7. The apparatus of claim 6, wherein said ball catcher comprises slots therein to permit fluid flow therethrough.

8. The apparatus of claim 7, wherein said acid sub comprises threadably engaged top and bottom subs.

9. The apparatus of claim 1, further comprising a downhole vibration device attached thereto.

10. An apparatus to be run on a pipe downhole in a wellbore, to enable bypassing fluid flow around a portion of downhole equipment, comprising:

an elongated central housing having a bore therethrough, said central housing comprising one or more bypass ports through a wall thereof permitting fluid flow through said wall, and having one or more internal grooves at a lower end thereof;

an elongated mandrel slidably disposed in said bore of said central housing, said mandrel having a bore therethrough and one or more bypass ports through a wall thereof, said mandrel comprising a spline which engages said one or more internal grooves in said central housing and prevents relative rotation between said mandrel and said housing, said mandrel comprising an external first shoulder proximal a lower end thereof, limiting upward movement of said mandrel into said central housing;

a spring disposed in a chamber formed between said bore of said central housing and said mandrel and around said mandrel, biasing said mandrel downwardly out of a lower end of said central housing;

a first set of shear screws connecting said central housing and said mandrel and holding said mandrel in a first extended position, wherein said bypass ports in said central housing and said mandrel are not aligned and fluid flow therethrough is prevented;

one or more shearable retaining screws engaged with said central housing and extending into said bore thereof, wherein when said shear screws are sheared and said mandrel is biased downward and outwardly from said central housing, said retaining screws engage a second shoulder on said mandrel and prevent said mandrel from further downward movement out of said central housing beyond a second extended position, said bypass ports in said central housing and said mandrel being aligned when said mandrel is in said second extended position, permitting fluid flow to flow from said bore of said mandrel outside of said central housing;

a mandrel nut encircling said mandrel and positioned within said central housing, engageable with an internal shoulder of said central housing and within said bore of said central housing, whereby when said shearable retaining screws are sheared said mandrel may be biased downwardly and out of said central housing beyond said second extended position to a third extended position, wherein said bypass ports in said central housing and said mandrel are not aligned and fluid flow therethrough is prevented.

11. The apparatus of claim 10, wherein said central housing comprises one or more metering holes therethrough, through which fluid may enter and leave said chamber, movement of said mandrel within said central housing being dampened by said fluid flow.

12. The apparatus of claim 11, wherein said central housing further comprises top and bottom subs attached to the upper and lower ends thereof, said top and bottom subs comprising threaded connections for attachment to a pipe string.

13. The apparatus of claim 12, wherein said bypass ports in said mandrel are positioned proximal an upper end thereof, and said bypass ports in said housing are positioned in said top sub.

14. The apparatus of claim 10, further comprising an acid sub connected to a lower end of said central housing, said acid sub comprising an elongated member having a bore therethrough, a resilient ball seat disposed in said bore, and a ball catcher disposed below said ball seat and adapted to receive balls after passage through said ball seat.

15. The apparatus of claim 14, wherein said ball catcher comprises slots therein to permit fluid flow therethrough.

16. The apparatus of claim 15, wherein said acid sub comprises threadably engaged top and bottom subs.

17. A bypass tool, for placement downhole in a wellbore, comprising:

an elongated central housing having a bore therethrough, said central housing comprising one or more bypass ports through a wall thereof, and having one or more internal grooves at a lower end thereof;

an elongated mandrel disposed in said bore of said central housing, said mandrel having a bore therethrough, said mandrel comprising a spline which engages said one or more internal grooves in said central housing and prevents relative rotation between said mandrel and said housing;

a spring disposed in said central housing, biasing said mandrel out of a lower end of said central housing;

a mandrel nut on said mandrel, engageable with a shoulder within said central housing, said mandrel nut comprising bypass ports therethrough, a first set of shear screws connecting said central housing and said mandrel and holding said mandrel in a first extended position, wherein said bypass ports in said central housing and said mandrel nut are not aligned and fluid flow therethrough is prevented;

one or more shearable retaining screws engaged with said central housing and extending into said bore thereof, wherein when said shear screws are sheared and said mandrel is biased axially outwardly from said central housing, said retaining screws engage a shoulder on said mandrel and prevent said mandrel from further downward movement out of said central housing beyond a second extended position, said bypass ports in said central housing and said mandrel nut being aligned in said second extended position, permitting fluid flow to flow from said bore of said mandrel outside of said central housing;

whereby when said shearable retaining screws are sheared said mandrel may be biased out of said central housing beyond said second extended position to a third extended position, wherein said bypass ports in said central housing and said mandrel nut are not aligned and fluid flow therethrough is prevented.

18. A bypass tool, for placement downhole in a wellbore, comprising:

an elongated central housing having a bore therethrough, said central housing comprising one or more bypass ports through a wall thereof, and having one or more internal grooves at a lower end thereof;

an elongated mandrel disposed in said bore of said central housing, said mandrel having a bore therethrough and one or more bypass ports through a wall thereof, said mandrel comprising a spline which engages said one or more internal grooves in said central housing and prevents relative rotation between said mandrel and said housing;

a spring disposed in said central housing, biasing said mandrel out of a lower end of said central housing;

a first set of shear screws connecting said central housing and said mandrel and holding said mandrel in a first extended position, wherein said bypass ports in said central housing and said mandrel are not aligned and fluid flow therethrough is prevented;

one or more shearable retaining screws engaged with said mandrel and extending into a slot in said housing, wherein when said shear screws are sheared and said mandrel is biased axially outwardly from said central housing, said retaining screws engage a shoulder in said slot and prevent said mandrel from further downward movement out of said central housing beyond a second extended position, said bypass ports in said central housing and said mandrel being aligned in said second extended position, permitting fluid flow to flow from said bore of said mandrel outside of said central housing;

a mandrel nut on said mandrel, engageable with a shoulder within said central housing, whereby when said shearable retaining screws are sheared said mandrel may be biased out of said central housing beyond said second extended position to a third extended position, wherein said bypass ports in said central housing and said mandrel are not aligned and fluid flow therethrough is prevented.

* * * * *